US007819786B1

(12) United States Patent
Cao

(10) Patent No.: US 7,819,786 B1
(45) Date of Patent: Oct. 26, 2010

(54) DUMBBELL ASSEMBLY

(76) Inventor: Guofang Cao, 2641 Shady Ridge La., Diamond Bar, CA (US) 91765

( * ) Notice: Subject to any disclaimer, the term of this patent is extended or adjusted under 35 U.S.C. 154(b) by 73 days.

(21) Appl. No.: 12/432,010

(22) Filed: Apr. 29, 2009

(51) Int. Cl.
*A63B 21/072* (2006.01)
*A63B 21/075* (2006.01)

(52) U.S. Cl. ..... 482/106; 482/107; 482/108

(58) Field of Classification Search ..... 482/44, 482/49–50, 92–93, 106–108; D21/662, 679–682; *A63B 21/072, 21/075*
See application file for complete search history.

(56) References Cited

U.S. PATENT DOCUMENTS 7,131,938 B2 * 11/2006 Cao ..... 482/106
7,491,156 B1 * 2/2009 GaoYong ..... 482/108
7,591,772 B2 * 9/2009 Shillington ..... 482/107
2004/0162196 A1 * 8/2004 deGroot ..... 482/106
2007/0249475 A1 * 10/2007 Cao ..... 482/107
2009/0023563 A1 * 1/2009 Liang ..... 482/106
2009/0270233 A1 * 10/2009 Cao ..... 482/108

* cited by examiner

*Primary Examiner*—Loan Thanh
*Assistant Examiner*—Oren Ginsberg
(74) *Attorney, Agent, or Firm*—Jen-Feng Lee

(57) ABSTRACT

Normal dumbbell assembly tends to have loose of wobbly weight-heads, after repeated use, producing inherent risk of danger for users. Present invention described and claimed a dumbbell assembly that has a structure not likely to have loose or wobbly weight-heads, and thus reducing and avoiding potential harms and dangers to users, due to the tight and secure attachment of weight-heads to the dumbbell handle.

3 Claims, 4 Drawing Sheets

DUMBBELL ASSEMBLY

FIELD AND BACKGROUND OF THE INVENTION

The present invention relates generally to an improved design and construction of dumbbell weight-head assembly.

Dumbbells are commonly found in fitness centers and gyms, as well as for sale to private users. Typically, two weight-heads are attached to the two ends of a handle bar, forming a fixed weight dumbbell.

Mostly, the attachment of the weight-heads is done by direct welding of the weight-heads to the handle bar. Alternatively, weight-head may be screwed into a hollowed thread hole along and axial direction of the handle.

During normal usage, dumbbells are constantly being dropped, impacted and thrown around, in gyms and private houses. If the welding is not done solidly, which oftentimes happen as a result of mass-production, the weld junction tend to break and the weight-heads are likely to be detached away from the handle and cause injuries to users or damages to nearby objects.

In the case where the weight-heads are screwed on, usually by a single bolt or screw going into the hole along the axial direction of the handle, oftentimes the weight-heads will get wobbly or loose from the handle after some period of use by users. Such loose or wobbly weight-heads present potential great danger to users.

The assembly structure described and claimed in present invention will produce a dumbbell with weight-heads that are secure and tight and not likely to have the problems stated hereinabove.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

Figure 1:
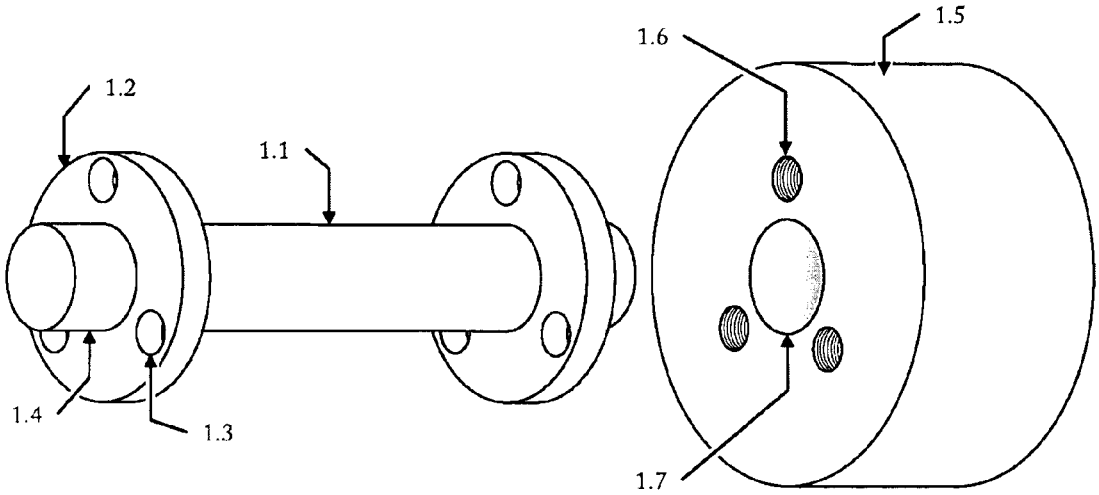
FIG. 1 shows the dis-assembled view of present invention.

In FIG. 1, a dumbbell assembly having two weight-heads is shown. Two flanges 1.2 are formed at some offset length from the two ends of the handle 1.1, leaving two stub 1.4 on the two outer-most portion of said handle 1.1.

Figure 2:
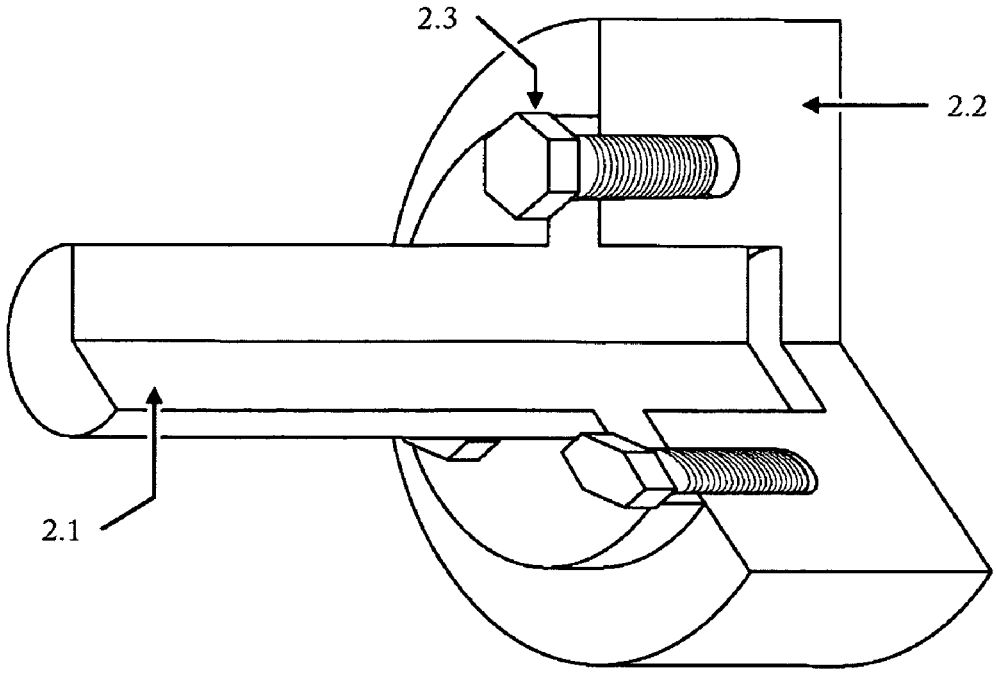
FIG. 2 shows the close-up cut-out view of a weight-head assemble to the flange, as described in present invention.

A plurality of through holes 1.3 are made to the flanges 1.2; corresponding number of holes 1.6 on 2 weight-heads 1.5 are made to contain regular (clockwise) threadlines, so that screws (or bolts) 2.3 (with matching regular threadlines) can be used to attach and tighten the flanges 1.2 to the weight-heads 1.5, when the stub 1.4 is inserted into the center hole 1.7 of the weight-heads 1.5, as shown in FIG. 2.

Figure 3:
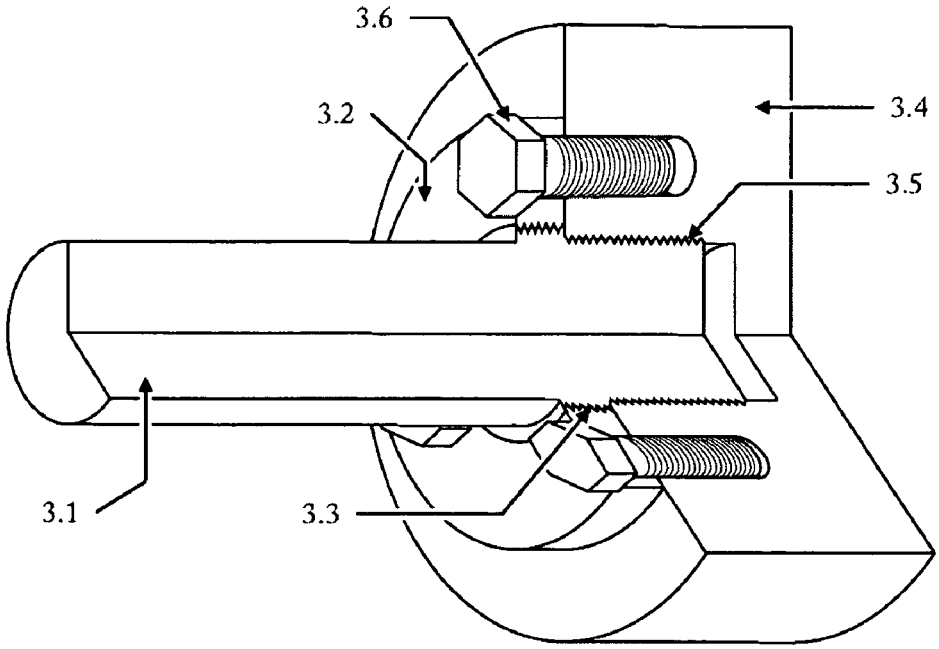
FIG. 3 shows the outer-most portion of the handle is machined to have reverse (counter-clockwise) threadlines and the center hole of the weight-heads contains matching threadlines.

FIG. 3 shows that reverse threadlines 3.3 are machined to the junction to receive flanges 3.2 containing matching threadlines. The stub portion of the handle contains regular threadlines 3.5 to received the center hole of weight-heads containing matching threadlines.

For this type of reverse threadlines and regular threadlines made on the handle to assemble the flanges (3.2 in FIG. 3, or 1.2 in FIG. 1), the effective diameter of the junction portion (the reverse threadlines part) is bigger than that of the stub portion that is used to receive the weight-heads.

Similar to the depiction in FIG. 2, after weight-heads 3.4 are assembled to stubs containing the threadlines 3.5, a plurality of screws or bolts 3.6 are used to attach and tighten the weight-heads 3.4 to the flanges 3.2.

Figure 4:
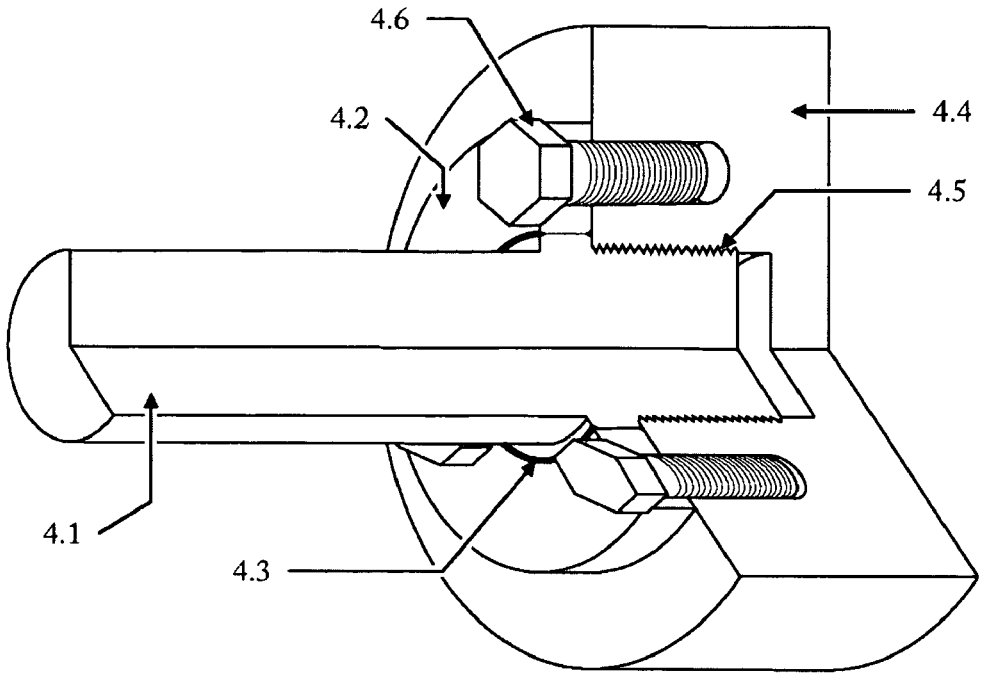
FIG. 4 shows the flanges are welded to the handle by way of welding.

FIG. 4 shows that, alternatively, flanges 4.2 may be assembled to handle 4.1 by welding. Weld line 4.1 is shown at the junction area where flanges 4.2 is formed on the handle 4.1, leaving a stub portion for inserting into the weight-heads 4.4 and tightening by bolts or screws 4.6.

What is claimed is:

1. Dumbbell assembly, comprising:

a. a handle having two opposing ends with a stub portion near each of the two opposing ends;

b. a flange formed at each junction of the handle and the stubs, with a plurality of through holes evenly made through each of the flanges; and, c. two weight-heads, each containing a center hole for snugly receiving the stub and corresponding holes for the through holes of the flanges whereby screws are selectively tightened from the through hole into the corresponding holes on the weight-heads; wherein the stubs of said handle are machined to have regular threadlines, and the center hole of said weight-heads is machined to contain matching threadlines, so that the weight-heads are screwed into to the stubs of the handle, before the screws are used to attach said flanges to weight-heads by the through holes on the flanges.

2. Dumbbell assembly of claim 1, wherein said flanges are formed at the junction of stubs and handle by creating reverse threadlines on the surface of the junction part of the handle and matching threadlines on the inner surface of the flanges, and the effective diameter of the junction of the handle is a bigger than that of the stub portion.

3. Dumbbell assembly of claim 1, wherein said flanges are formed at the junction of the stubs and handle by way of welding.

* * * * *